US007091819B1

(12) United States Patent
Forgue

(10) Patent No.: US 7,091,819 B1
(45) Date of Patent: Aug. 15, 2006

(54) VARIABLE RESISTOR CARD FOR A FUEL LEVEL SENSOR

(75) Inventor: John R. Forgue, Cheshire, CT (US)

(73) Assignee: TI Group Automotive Systems, L.L.C., Warren, MI (US)

( * ) Notice: Subject to any disclaimer, the term of this patent is extended or adjusted under 35 U.S.C. 154(b) by 0 days.

(21) Appl. No.: 11/158,389

(22) Filed: Jun. 22, 2005

(51) Int. Cl.
*H01C 10/32* (2006.01)

(52) U.S. Cl. ..... 338/162; 338/33; 338/185; 338/190

(58) Field of Classification Search ..... 338/33, 338/162, 185, 188, 190, 193, 307, 309; 73/308, 73/317; 219/201, 202
See application file for complete search history.

(56) References Cited

U.S. PATENT DOCUMENTS 3,890,478 A 6/1975 Riddel
3,952,593 A 4/1976 Ells
4,495,524 A 1/1985 Kakuhashi et al.
4,510,436 A 4/1985 Raymond
4,594,893 A 6/1986 Lombard et al.
4,609,913 A 9/1986 Arbogast et al.
4,638,291 A 1/1987 Puscasu
4,642,602 A * 2/1987 Maisch et al. ..... 338/162
4,667,518 A * 5/1987 Iden ..... 73/753
4,827,769 A 5/1989 Riley et al.
4,931,764 A 6/1990 Gaston
5,051,719 A 9/1991 Gaston et al.
5,051,921 A 9/1991 Paglione
5,053,283 A 10/1991 Brown
5,119,063 A 6/1992 Nonnenmacher et al.
5,129,261 A 7/1992 Riley
5,138,881 A 8/1992 Riley et al.
5,201,221 A 4/1993 Forgacs et al.
5,243,318 A * 9/1993 Greenstein ..... 338/195
5,275,044 A 1/1994 Riley
5,331,234 A 7/1994 Merritt et al.
5,379,016 A 1/1995 Smitih et al.
5,399,979 A 3/1995 Henderson et al.
5,417,312 A 5/1995 Tsuchitani et al.
5,502,380 A 3/1996 Sittler et al.
5,554,965 A 9/1996 Sundberg
5,743,136 A 4/1998 Gaston et al.
5,746,088 A * 5/1998 Sawert et al. ..... 73/317
6,025,772 A 2/2000 Chen
6,127,916 A * 10/2000 Cooper et al. ..... 338/190
6,164,132 A 12/2000 Matulek
6,186,001 B1 2/2001 Baker (Continued)

*Primary Examiner*—Tu Hoang
(74) *Attorney, Agent, or Firm*—Reising, Ethington, Barnes, Kisselle, P.C.

(57) ABSTRACT

A variable resistor card for a fuel level sensor includes a first wiper contact area, a first electrically conductive pathway electrically communicated to the first wiper contact area, a second wiper contact area, a second electrically conductive pathway electrically communicated to the second wiper contact area, and a nonconductive layer on at least one of the first and second electrically conductive pathways.

15 Claims, 3 Drawing Sheets

U.S. PATENT DOCUMENTS

| | | | | |
|---|---|---|---|---|
| 6,212,950 | B1 | 4/2001 | Cooper et al. | |
| 6,269,695 | B1 | 8/2001 | Cesternimo et al. | |
| 6,369,690 | B1 | 4/2002 | Chen | |
| 6,433,560 | B1 | 8/2002 | Hansen et al. | |
| 6,518,873 | B1 | 2/2003 | O'Regan et al. | |
| 6,578,416 | B1 | 6/2003 | Vogel et al. | |
| 6,624,755 | B1 | 9/2003 | Chamberlin | |
| 6,681,628 | B1 | 1/2004 | Sawert et al. | |
| 6,707,680 | B1 | 3/2004 | Schaper | |
| 6,761,193 | B1 | 7/2004 | Cotton et al. | |
| 6,828,898 | B1 | 12/2004 | Dedert et al. | |
| 6,886,403 | B1 * | 5/2005 | LaBarge et al. | 73/304 C |
| 2005/0040929 | A1 * | 2/2005 | Dedert et al. | 338/160 |

* cited by examiner

VARIABLE RESISTOR CARD FOR A FUEL LEVEL SENSOR

FIELD OF THE INVENTION

This invention relates generally to automotive fuel level sensors, and more particularly to variable resistor cards for fuel level sensors.

BACKGROUND OF THE INVENTION

A variable resistor is often used in a fuel level sensor to detect a change in fuel level in a fuel tank of an automobile. A typical variable resistor assembly has a wiper mechanically movable across contact segments of a resistor to change resistance value without interrupting a circuit to which the resistor is connected. The wiper is movable, usually in response to a float in a fuel tank responsive to changes in the level or depth of liquid fuel in the fuel tank. The typical variable resistor assembly has a resistor card including a ceramic substrate, two separate terminals on the substrate, and two separate and respective arcuate wiper contact areas on the substrate that are electrically connected with the terminals. Contact segments of at least one of the wiper contact areas are electrically connected to a resistor. Typically the wiper is pivotably mounted by an arm in relation to the substrate and bridges the wiper contact areas.

Typically, the resistance value of the variable resistor assembly varies in accordance with the position of the float. As the level of fuel within a fuel tank changes, the float member and actuator arm move and thereby cause the wiper to sweep over the arcuate wiper contact areas to change an effective length of the variable resistor between the terminals and thereby vary the effective resistance of the variable resistor. In accordance with the change in resistance, the output voltage of the resistor card changes and, thus, effects a change—such as from "Full" toward "Empty"—in a remote fuel level indicator useable by a driver in a passenger compartment of a vehicle.

In use, existing fuel level sensors can fail as a result of wiper and contactor wear associated with hundreds of thousands of resistor cycles and as a result of conductive contact segments reacting with liquid fuel or byproducts or additives contained within the liquid fuel. In an effort to combat such failure of fuel level sensors, various manufacturers have designed conductive wiper contactors and conductive contact segments composed of materials having an increased durability in the presence of a hostile fuel tank environment. Included in these materials are precious metals such as platinum, gold, silver, and palladium, which can be combined into alloys. Unfortunately, however, the cost of using such expensive alloy materials greatly contributes to the overall cost of a fuel level sensor assembly and such alloyed conductive layers are usually relatively unstable and require one or more plating and/or coating steps. The alloyed conductive contact segments require one or more layers of plating of nickel or nickel alloy material, and resistive portions of the resistor must be coated with an insulative protective coating prior to plating the alloyed conductive layers to prevent the resistive portions from becoming plated.

Moreover, existing fuel level sensors do not provide a means for preventing corrosion-inducing leakage currents between high potential areas. The electrical potential on a variable resistor card is highest between the terminals, is relatively high between respective electrically conductive pathways leading away from the terminals, and gradually decreases to near zero as the wiper and hence the circuit proceeds to distal portions of the wiper contact areas. Where the respective electrically conductive pathways are relatively thin and/or where the distance between the respective electrically conductive pathways is relatively small, electrical current has a tendency to leak therebetween. Such current leakage leads to corrosion of the electrically conductive pathways, the buildup of deposits, and eventual failure of the variable resistor assembly.

SUMMARY OF THE INVENTION

An exemplary embodiment of a variable resistor card for a fuel level sensor has portions that are protected against damaging electrolysis-induced current leakage and resultant corrosion. The variable resistor includes a first wiper contact area, a first electrically conductive pathway electrically communicated to the first wiper contact area, a second wiper contact area, a second electrically conductive pathway electrically communicated to the second wiper contact area, and a nonconductive layer on at least one of the first and second electrically conductive pathways. The nonconductive layer may be a glass which encapsulates and effectively electrically insulates one or both of the pathways.

At least some of the objects, features and advantages that may be achieved by at least certain embodiments of the invention include providing a variable resistor that is readily adaptable to various applications including liquid level sensors; a variable resistor configuration that resists corrosion due to current leakage between electrically conductive pathways; a variable resistor that does not require use of relatively unstable precious metal alloys that necessitate coating of resistive portions and plating of conductive portions; suitable for use in direct current systems of relatively large potential or maximum voltage; is of relatively simple design and economical manufacture and assembly, rugged, durable, and reliable, and in service has a long useful life.

Of course, other objects, features and advantages will be apparent in view of this disclosure to those skilled in the art. Various other devices embodying the invention may achieve more or less than the noted objects, features or advantages.

BRIEF DESCRIPTION OF THE DRAWINGS

These and other objects, features and advantages of the present invention will be apparent from the following detailed description of the preferred embodiment and best mode, appended claims, and accompanying drawings in which:

DETAILED DESCRIPTION OF THE PREFERRED EMBODIMENTS

Figure 1:
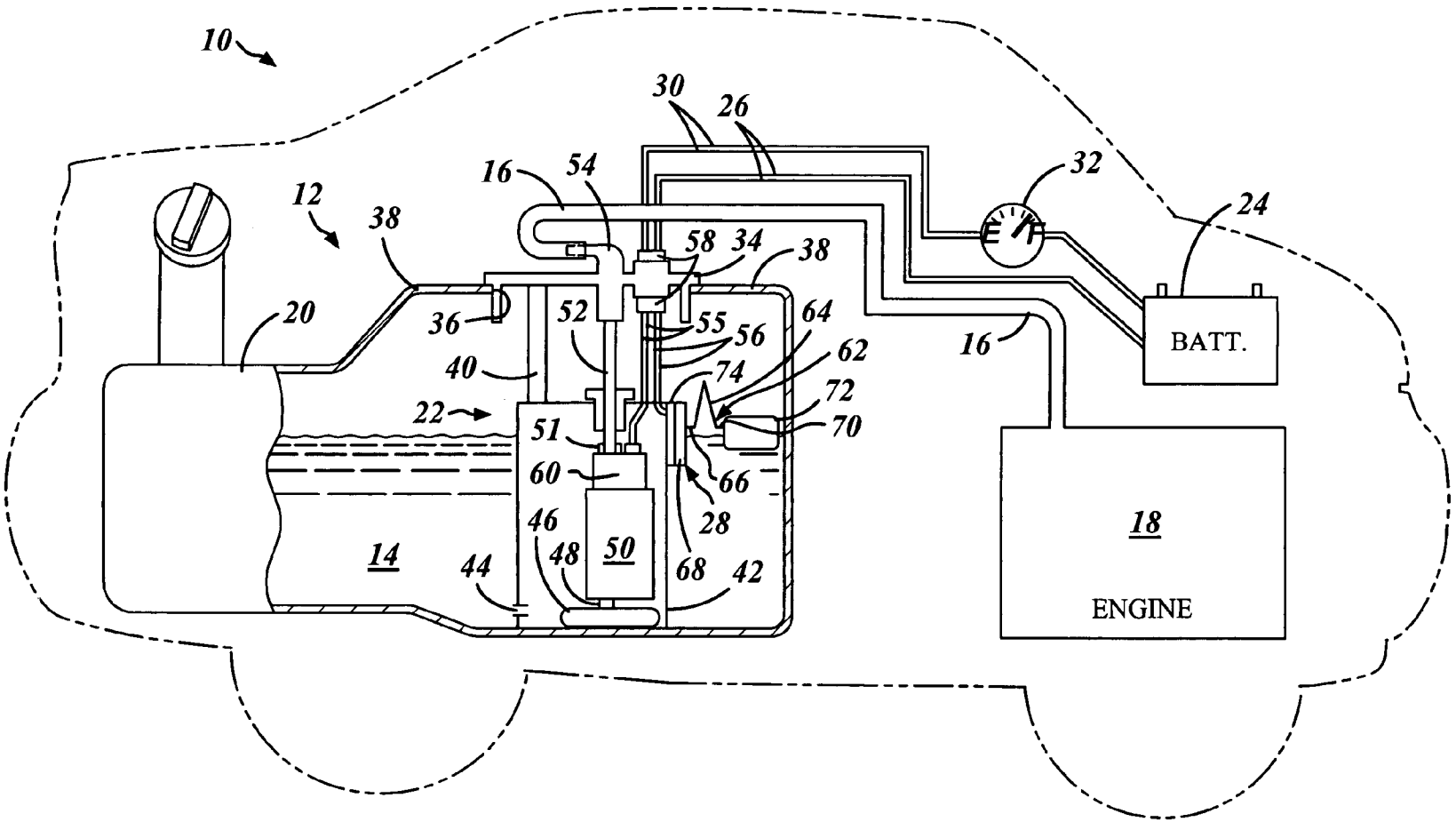
FIG. 1 is a schematic view of a vehicle including a fuel tank equipped with a fuel pump module having an exemplary embodiment of a fuel level sensor mechanism.

Referring in more detail to the drawings, FIG. 1 schematically illustrates a vehicle 10 including a fuel tank assembly 12 for storing fuel 14 and supplying the fuel 14 through a fuel line 16 to an internal combustion engine 18 that powers the vehicle 10. The fuel tank assembly 12 includes a fuel tank 20 for housing the fuel 14 and a fuel pump module 22 mounted within the fuel tank 20 that pumps fuel 14 out of the fuel tank 20 to the engine and that is electrically driven by a vehicle battery 24 via wires 26. The fuel pump module 22 also includes a fuel level sensor 28 for sensing the level of the fuel 14 within the fuel tank 20 and sending a signal, via wires 30, indicative of the fuel level to a fuel level indicator 32 for observation and use by a vehicle driver within a passenger compartment of the vehicle 10.

When the fuel pump module 22 is fully assembled to the fuel tank 20, a flange 34 of the module 22 is engaged sealably with an aperture 36 in a fuel tank wall 38 and housing 42 of the fuel pump module 22 is suspended within the fuel tank 20 from the flange 34, by one or more posts 40. The housing 42 has a fuel inlet 44 to communicate the fuel 14 from within the fuel tank 20 to a fuel filter 46 connected to a fuel inlet 48 of a fuel pump 50. The fuel pump 50 has a fuel outlet 51 that connects to a tube 52 that communicates through a fuel supply fitting 54 of the flange 24 with the fuel line 16. Electrical leads 55, 56, with associated connectors 58, extend through the flange to provide electrical power to an electric motor 60 of the fuel pump 50 and to the fuel level sensor 28.

Still referring to FIG. 1, the fuel level sensor 28 preferably includes a wiper arm float mechanism 62, which has an elongated float arm 64 having a base end 66 bent at an approximate right angle and carried pivotally by a sensor base 68. A distal float end 70 of the float arm 64 is also bent at an approximate right angle and pivotally carries a buoyant or hollow plastic float 72. The buoyant float 72 may be generally planar and rectangular or cylindrical in shape and floats on the surface of the fuel 14 contained within the fuel tank 20. The length of the float arm 64 is dictated by the shape or depth of the fuel tank 20 and should be long enough to allow the float 72 to float upon the surface of the fuel 14 between a maximum and minimum elevation (i.e. full to empty fuel tank conditions). As the fuel level changes, the float 72 rises or lowers with the surface of the fuel 14 causing the float arm 64 to pivot about the base end 66, thus sliding, sweeping, or wiping an electrically conductive wiper or contactor across a portion of a resistor card 74 of the fuel level sensor 28 to produce the fuel level electric signal carried by the leads 56 and wires 30 to the fuel level indicator 32.

Figure 2:
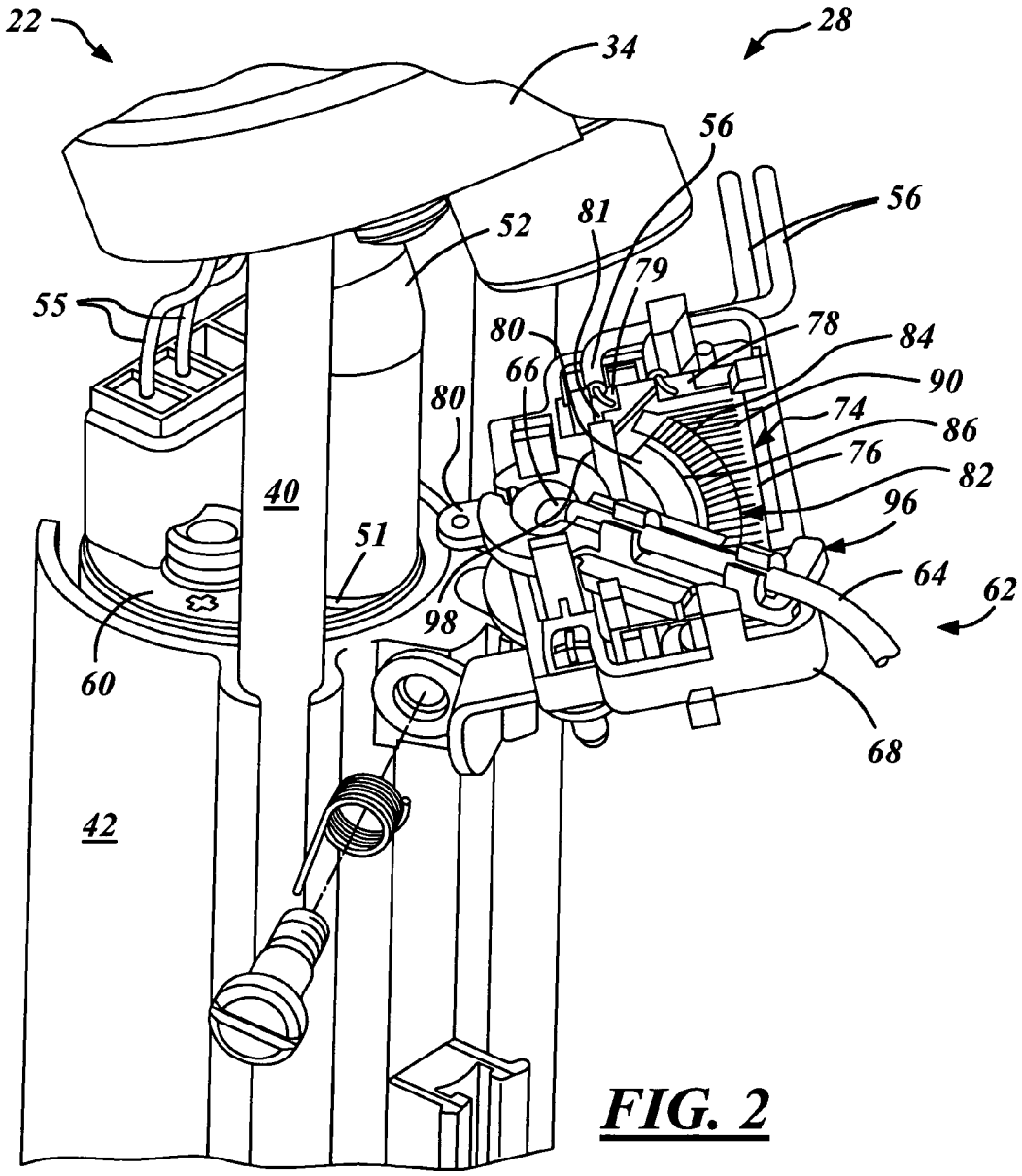
FIG. 2 is a partial enlarged perspective view of the fuel pump module illustrating the fuel level sensor mechanism.
Figure 3:
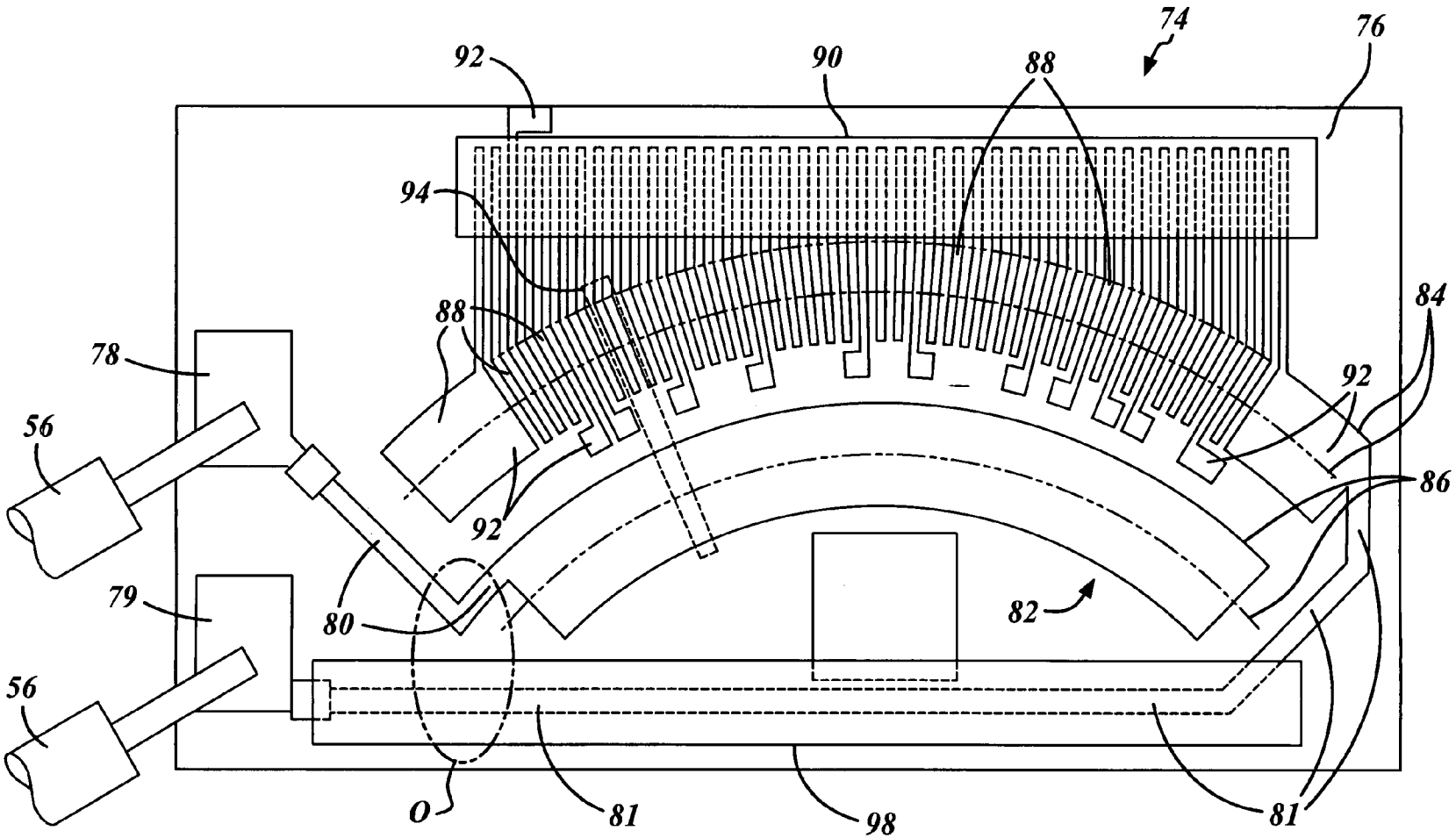
FIG. 3 is plan view of an exemplary variable resistor card of the fuel level sensor mechanism of FIG. 1.

Referring now to FIGS. 2 and 3, the fuel level sensor 28 includes a variable resistor card 74 that is carried by the sensor base 68 and that is composed of a ceramic substrate 76 imprinted with variable resistor elements. The leads 56 are soldered to electrically conductive connection pads 78, 79 that are imprinted upon the ceramic substrate 76. The variable resistor card 74 also includes wiper contact areas 82 that are imprinted upon the ceramic substrate 76. The wiper contact areas 82 are generally semi-circular or arcuate shapes that are preferably concentrically arranged with respect to the pivoting axis of the float arm 64. First and second printed wires, or electrically conductive pathways 80, 81, are imprinted upon the ceramic substrate 76 to electrically communicate the conductive connection pads 78, 79 to the wiper contact areas 82.

The wiper contact areas 82 include a generally resistive first contact area or arc 84 and a generally conductive second contact area or arc 86. The resistive contact arc 84 is preferably segmented to define a plurality of conductive contact segments 88 that are separated by open spaces. Laterally opposed segments at the opposite ends of the resistive contact arc 84 are larger than the other conductive contact segments 88 therebetween and may be used as test pads as well as conductive contact segments 88. The plurality of conductive contact segments 88 is communicated to a corresponding resistor trace 90. Accordingly, the resistor trace 90 enables effective resistance of the resistive contact arc 84 to increase incrementally from the end of the arc 86 that is connected to the printed wire 81 to the opposite end. Also, a number of test pads 92 are provided in communication with the resistive contact arc 84 as a manufacturing aid, as is generally known to those of ordinary skill in the art.

In contrast to the segmented resistive contact arc 84, the conductive contact arc 86 is preferably continuous from one end to the other. The conductive contact arc 86 is spaced radially inside of the resistive contact arc 84 so that an electrical wiper or contactor 94, which is mounted on a bottom side of a nonconductive saddle 96 carried by the float arm 64, contacts and electrically bridges a portion of the conductive contact arc 86 with a predetermined one or more of the resistive segments 88 of the resistive contact arc 84 as the float arm 64 sweeps across the card 74 as the buoyant float 72 responds to changes in fuel level. The pathways 80, 81 do not come into contact with the wiper 94. Those of ordinary skill in the art will recognize that the conductive contact arc 86 could also be provided instead as a generally resistive contact arc having spaced apart resistive segments in contact with resistor segments, such that both wiper contact areas 82 are segmented resistive arcs. In any case, a variable resistor of the variable resistor card 74 substantially includes the wiper contact areas 82 and the wiper 94.

The various elements of the variable resistor card 74 may be produced using any suitable process known to those of ordinary skill in the art, including but not limited to screen printing, depositing molten material, chemically etching and/or coating the ceramic substrate 76, attaching or adhering separately manufactured elements to the ceramic substrate 76, and the like. In any case, the conductive contact arc 86, the resistive contact arc 84, and the plurality of conductive contact segments 88 are all preferably composed of a thick film conductive "ink" material such as Dupont® 7484 material, or the like. Preferably, the resistor trace 90, and the contact arcs 84, 86 are imprinted on the ceramic substrate 76, as is generally known in the art of thick film screen printing in printed circuit board manufacturing. The resistor traces 90 is preferably additionally composed of a top layer of thick film resistor glaze such as Dupont® 2000 series or the like. Also preferably, and in contrast with existing manufacturing techniques for variable resistor cards for fuel level sensors, the resistor trace 90 and the contact arcs 84, 86 need not be further processed with multiple layers such as coatings, platings, and the like. In other words, the resistor trace 90 and the contact areas 82 are void of additional coatings, platings, and the like. Rather, the materials selected for the resistor trace 90 and the contact areas 82 are preferably stable and relatively resistant to attack by volatile sulphur laden fuels.

Although the electrically conductive pathways 80, 81 are not in contact with the wiper 94 and, therefore, are not prone to mechanical wear, they can be susceptible to electrolysis-induced corrosion. Corrosion occurs relatively fast in areas of the resistor card 74 with high mounting density when the pathways 80, 81 are relatively close and fine, and even faster in areas of the resistor card 74 with high direct current potential such as the exemplary area on the card shown by oval 0. For example, areas of the resistor card 74 having conductive pathways that are closer than 2.0 mm and less than 0.5 $mm^2$ in cross-sectional area, may be particularly susceptible to corrosion. This is because, at a constant voltage, the electric field between the pathways 80, 81 rises inversely and exponentially with the spacing between the pathways 80, 81, and high electric fields are believed to yield leakage currents between the pathways 80, 81, thereby causing migration of metal therebetween.

The metal migration is also known as electrochemical migration, electrolytic migration, ion migration, and the like. In any case the metal tends to migrate in the form of ions from an anodic pathway portion to a cathodic pathway portion where the metal gets deposited. Such an electrolytic phenomenon leads to the corrosion of one or both of the pathways 80, 81 and, ultimately, failure of the variable resistor card 74.

Therefore, one or both of the pathways 80, 81 are preferably protected against the corrosive effects of electrolytic metal migration. For example, a nonconductive material 98 is preferably selectively applied to cover at least a portion of the second pathway 81. The nonconductive material 98 may be any desired material that is suitable to electrically insulate one or both of the pathways 80, 81 against electrical fields, or current leakage, therebetween. The nonconductive material 98 may be an electric insulator, such as Dupont® 9137 glass encapsulant material, or the like. Such glass encapsulants are thick film compositions intended to form an insulating and protective layer and may be applied to the ceramic substrate 76 by screen printing and then firing in a furnace in an oxidizing atmosphere. The insulator 98 insulates the second pathway 81 from the influence of the electrical field that would normally persist between the pathways 80, 81 to prevent electrolytic migration of metal therebetween and, thus, inhibit and substantially prevent or minimize corrosion of one or more of the pathways 80, 81.

While the forms of the invention herein disclosed constitute a presently preferred embodiment, many others are possible. It is not intended herein to mention all the possible equivalent forms or ramifications of the invention. It is understood that terms used herein are merely descriptive, rather than limiting, and that various changes may be made without departing from the spirit and scope of the invention as defined by the following claims.

What is claimed is:

1. A variable resistor card for a fuel level sensor, comprising:

a first wiper contact area;

a first electrically conductive pathway electrically communicated to the first wiper contact area;

a second wiper contact area;

a second electrically conductive pathway electrically communicated to the second wiper contact area; and a nonconductive layer covering at least a portion of at least one of the first or second electrically conductive pathways to resist current leakage between the pathways and thereby minimize electrolysis-induced corrosion.

2. The variable resistor card of claim 1 wherein the nonconductive layer is composed of a thick film insulating material.

3. The variable resistor card of claim 2 wherein the nonconductive layer is composed of a glass encapsulant.

4. The variable resistor card of claim 1 wherein at least a portion of the first electrically conductive pathway is within 2.0 mm of at least a portion of the second electrically conductive pathway.

5. The variable resistor card of claim 1 wherein at least a portion of at least one of the first or second electrically conductive pathways has a cross-sectional area of no greater than 0.5 $mm^2$.

6. A variable resistor card for a fuel level sensor, comprising:

a substrate;

a first wiper contact area disposed on the substrate;

a first terminal pad disposed on the substrate;

a first electrically conductive pathway disposed on the substrate and electrically communicating the first wiper contact area to the first terminal pad;

a second wiper contact area disposed on the substrate;

a second terminal pad disposed on the substrate;

a second electrically conductive pathway disposed on the substrate and electrically communicating the second wiper contact area to the second terminal pad; and a nonconductive layer covering at least a portion of at least one of the first or second electrically conductive pathways to resist current leakage between the pathways and thereby minimize electrolysis-induced corrosion.

7. The variable resistor card of claim 6 wherein the nonconductive layer is composed of a thick film insulating material.

8. The variable resistor card of claim 7 wherein the nonconductive layer is composed of a glass encapsulant.

9. The variable resistor card of claim 6 wherein at least a portion of the first electrically conductive pathway is within 2.0 mm of at least a portion of the second electrically conductive pathway.

10. The variable resistor card of claim 6 wherein at least a portion of at least one of the first or second electrically conductive pathways has a cross-sectional area of no greater than 0.5 $mm^2$.

11. A fuel level sensor comprising:

a float arm mechanism including:

a base;

a float;

a float arm having a float end carrying the float and a base end pivotably carried by the base;

a variable resistor card carried by the base of the float arm mechanism and including:

a substrate at least partially composed of a ceramic material;

a resistive wiper contact area on the substrate;

a first electrically conductive pathway on the substrate and in electrical communication with the resistive wiper contact area;

a conductive wiper contact area on the substrate;

a second electrically conductive pathway on the substrate and in electrical communication with the conductive wiper contact area; and a nonconductive layer covering at least a portion of one of the first or second electrically conductive pathways to resist current leakage between the pathways and thereby minimize electrolysis-induced corrosion.

12. The fuel level sensor of claim 11 wherein the nonconductive layer is composed of a thick film insulating material.

13. The fuel level sensor of claim 12 wherein the nonconductive layer is composed of a glass encapsulant.

14. The fuel level sensor of claim 11 wherein at least a portion of the first electrically conductive pathway is within 2.0 mm of at least a portion of the second electrically conductive pathway.

15. The fuel level sensor of claim 11 wherein at least a portion of at least one of the first or second electrically conductive pathways has a cross-sectional area of no greater than 0.5 $mm^2$.

* * * * *